US008211503B2

(12) United States Patent
Tsao et al.

(10) Patent No.: US 8,211,503 B2
(45) Date of Patent: Jul. 3, 2012

(54) METHOD FOR MAKING DEVICE HOUSING

(75) Inventors: Ben-Ding Tsao, Taipei Hsien (TW); Wen-Lin Xiong, Shenzhen (CN); Xian-Ming Wu, Shenzhen (CN); Jian-Bao Han, Shenzhen (CN); Dian-Ming Zhu, Shenzhen (CN); Chong Cai, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 262 days.

(21) Appl. No.: 12/622,689

(22) Filed: Nov. 20, 2009

(65) Prior Publication Data

US 2010/0247802 A1 Sep. 30, 2010

(30) Foreign Application Priority Data

Mar. 25, 2009 (CN) ..... 2009 1 0301130

(51) Int. Cl.
*B05D 3/12* (2006.01)
*B05D 3/04* (2006.01)
*B06B 1/00* (2006.01)

(52) U.S. Cl. ..... 427/347; 427/346; 427/348; 427/349; 427/560; 427/600

(58) Field of Classification Search ..... 427/346, 427/347, 348, 349, 560, 600
See application file for complete search history.

(56) References Cited

U.S. PATENT DOCUMENTS

| | | | | |
|---|---|---|---|---|
| 4,643,912 | A * | 2/1987 | Nakagawa et al. | 427/526 |
| 6,117,384 | A * | 9/2000 | Laurin et al. | 264/297.2 |
| 2007/0160762 | A1 * | 7/2007 | Chaug et al. | 427/256 |
| 2008/0092920 | A1 * | 4/2008 | Shih et al. | 134/1 |
| 2009/0149575 | A1 * | 6/2009 | Bruchmann et al. | 524/31 |

* cited by examiner

*Primary Examiner* — Michael Cleveland
*Assistant Examiner* — James M Mellott
(74) *Attorney, Agent, or Firm* — Altis Law Group, Inc.

(57) ABSTRACT

A method for making device housing comprises: providing a transparent film; forming a coating on one surface of the film by printing ink containing metal powder on the film and ultrasonically treating the coating; and molding a substrate onto the coating.

6 Claims, No Drawings

METHOD FOR MAKING DEVICE HOUSING

BACKGROUND

1. Technical Field

The present disclosure relates to methods for making housings for devices, especially to a method for making a housing having a mirror-like appearance.

2. Description of Related Art

In-Mold Label (IML) process is now a typical method used to produce housings of electronic devices. Housings formed by IML processes commonly include a transparent plastic film and optionally a pattern printed on the film, and a plastic substrate molded on the film and pattern. The ink used for printing is usually added into metal powder, e.g., aluminum powder, to give the printing a mirror-like appearance. However, during the printing process, the metal powder cannot be deposited quickly onto the surface of the film but must first be given time to settle in the ink to eventually coat the surface of the film. If the settling time is not waited, the desired mirror-like appearance of the printing will be of poor quality. However, to wait through the settling time wastes time and is costly, and, can therefore, be unsuitable for high-speed automatic production lines.

Therefore, there is room for improvement within the art.

DETAILED DESCRIPTION

A method for making housings may comprise the following steps: providing a transparent film; forming a coating on one surface of the film by printing ink containing metal powder on the film; ultrasonically treating the coating; and molding a substrate onto the coating. Each step is described in more detail below.

A transparent film is provided. The film may be made of transparent plastic selected from a group consisting of polypropylene (PP), polyamide (PA), polycarbonate (PC), polymethyl methacrylate (PMMA) and polyethylene terephthalate (PET).

A coating is printed on one surface of the film to be, for example, decorative and/or protective. The ink used for printing the coating contains metal powder, such as copper powder, zinc powder or aluminum powder. After the printing process, the coated film is immediately placed on an ultrasonic machine to undergo ultrasonic treatment. The ultrasonic treatment may last for about 0.5-5 seconds at a power of about 350-800 watts. After the ultrasonic treatment, the coated film is baked in an oven. This gives the coating a mirror-like appearance.

A mold is provided to mold a substrate onto the coating. The substrate may be made of plastic selected from a group consisting of polyethylene (PE), polycarbonate (PC), acrylonitrile-butadiene-styrene (ABS), polymethyl methacrylate (PMMA) and polyethylene terephthalate (PET).

The present disclosure uses a method of ultrasonically treating a printed coating immediately after printing on the film by using a ink containing metal powder, which makes the metal powder completely and quickly deposit onto the surface of the film to give the coating a desired mirror-like appearance of suitable quality in a short time. The ultrasonic treatment process takes a few seconds and is highly effective.

The housing mentioned above may be a housing of, for example, a mobile phone, a portable game device, or a camera. The housing may also be a cover of a container or a container.

It is believed that the present embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A method for making device housing, comprising:
providing a transparent film;
forming a coating on one surface of the film by printing ink containing metal powder on the film;
ultrasonically treating the printed ink to make the metal powder settle within the ink onto the surface of the film; and
molding a substrate onto the coating.

2. The method as claimed in claim 1, wherein the film is made of transparent plastic selected from a group consisting of polypropylene, polyamide, polycarbonate, polymethyl methacrylate and polyethylene terephthalate.

3. The method as claimed in claim 1, wherein the metal powder is copper powder, zinc powder or aluminum powder.

4. The method as claimed in claim 1, wherein the ultrasonically treating process lasts for about 0.5-5 seconds at a power of about 350-800 watts.

5. The method as claimed in claim 1, wherein the substrate is made of plastic selected from a group consisting of polyethylene, polycarbonate, acrylonitrile-butadiene-styrene, polymethyl methacrylate and polyethylene terephthalate.

6. A method for making device housing, comprising:
providing a transparent film;
forming a coating on a portion of surface of the film by printing ink containing metal powder on the film;
ultrasonically treating the printed ink to make the metal powder settle within the ink onto the surface of the film; and
molding a substrate onto the coating and the film.

* * * * *